United States Patent [19]

Hood et al.

[11] 4,098,353

[45] Jul. 4, 1978

[54] ROTATABLE MINE DRILLING APPARATUS

[75] Inventors: Walter Hood; Joseph Subrick, both of Gary, W. Va.; Woods G. Talman, Upper St. Clair Township, Allegheny County, Pa.

[73] Assignee: United States Steel Corporation, Pittsburgh, Pa.

[21] Appl. No.: 687,112

[22] Filed: May 14, 1976

[51] Int. Cl.[2] ..... E21C 11/02; E21C 27/22

[52] U.S. Cl. ..... 173/20; 173/23; 173/27; 173/36; 173/43

[58] Field of Search ..... 173/20, 31, 34, 36, 173/39, 42, 43, 44, 45, 23

[56] References Cited

U.S. PATENT DOCUMENTS

| | | | |
|---|---|---|---|
| 1,783,290 | 12/1930 | Hulshizer | 173/36 |
| 2,162,553 | 6/1939 | Hirschberg | 173/42 X |
| 2,362,161 | 11/1944 | Sellars | 173/43 X |
| 2,610,029 | 9/1952 | Moon | 173/44 X |
| 2,734,724 | 2/1956 | Larcen | 173/43 |
| 3,057,416 | 10/1962 | Carlson et al. | 173/34 |
| 3,375,880 | 4/1968 | Pyles et al. | 173/37 |
| 3,515,227 | 6/1970 | Lokka | 173/43 |
| 3,659,656 | 5/1972 | Mares | 173/23 |
| 3,729,056 | 4/1973 | Paurat | 173/43 |
| 3,951,215 | 4/1976 | Galis | 173/23 |

*Primary Examiner*—Lawrence J. Staab
*Attorney, Agent, or Firm*—William A. Danchuk

[57] ABSTRACT

A roof drilling apparatus is provided for drilling a plurality of equally spaced holes in a mine roof. The apparatus includes a rotatable base upon which is mounted a drilling mechanism, thereby effecting a circular locus of travel to the drilling mechanism. Assuming equal angular separation between successive positions, the drilling mechanism may conveniently bore a multitude of equally distanced mine roof holes for accepting conventional roof bolts and supporting the roof without dislocative movement of the apparatus. The apparatus may be configured as a single or double unit or may be formed as an attachment to almost any conventional mining vehicle.

33 Claims, 9 Drawing Figures

ROTATABLE MINE DRILLING APPARATUS

BACKGROUND OF THE INVENTION

In underground mining in general, and in coal mining specifically, there is constant and well deserved attention paid to supporting the mine roof. There are a variety of ways in which roof support may be effected in "conventional" mines as well as in those mines which employ mining methods described as short wall and/or long wall mining. In "conventional" mines support is usually provided to a previously unsupported (and usually just mined) area of mine roof through conventional roof bolts and the like. These bolts are inserted into substantially vertically drilled holes into the mine roof by a bolter apparatus and generally have shapes, designs and lengths which depend, at least to a large extent upon the geographical makeup of the mine, the coal being mined, and the mine roof. The roof bolts with conventional, expandable, wedge-type members and bearing plates, as well as the "less conventional" and "newly" introduced resin bolts, tie the overhead strata together, thereby reducing and hopefully eliminating the possibility of roof falls. In the areas of conventional mining, where large blocks of coal are dislodged from the coal face, it is necessary to place these roof bolts along predetermined rows and files throughout the length and width of substantially all of the mined area. Moreover, there are federal, state and county regulations which stipulate exactly how much length of unsupported mine roof may be present between the last roof bolt and the coal face. These regulations are strictly followed by mine personnel because of the relationship between roof falls and unsupported mine roof areas between the last row of bolts and the face being mined. The gamble of men and equipment is far too great to extract coal and support the mine roof in any other way within "coventional" mining environments.

Under current mining regulations it is necessary, subsequent to the extraction of coal from the face, to move a portable self-propelled bolter vehicle into the haulageway and set both rows and files of roof bolts into the mine roof to reduce the length of unsupported roof. Generally, the maximum length of allowable unsupported roof is approximately 20 feet. When such a length has been reached, the coal miner is extracted and the bolting operation commences for that given area. The roof bolts which are set into the predrilled holes in the mine roof have center to center permissible distances of 4 feet with a maximum 4 foot distance between the rib and the next inward bolt. Due to the configuration of current designs, roof bolting machines currently available must drill and set successive series (usually three or four) of roof bolts (having a width of between two and four roof bolts) across the longitudinal axis of the haulageway, continuing down the haulageway until four rows have been set and the roof is again supported. Each of these successive lateral drilling series necessitates the retraction of temporary roof supports, the movement of the drilling vehicle four feet further into the passage and the positioning of the drilling machine so that the next series of holes drilled will be 4 feet from the last. Next, the temporary roof supports associated with the drilling apparatus must again be actuated for providing the necessary support for the mine roof during the drilling operation about to commence. It should become apparent that there is a bottleneck in the mining operation and that bottleneck is the roof drilling and bolting operation. It is necessary then, in order to increase mining efficiency, to decrease the time spent in the slowest operation which is holding up the rest of the mining operation. The fastest and most efficient mining machinery serves little good while a slow and cumbersome apparatus slows down the subsequent bolting operation.

The situation noted above is further complicated by the necessity for protecting the mine personnel operating the bolting apparatus during the drilling operation. In order to provide the operator with some protection from roof falls, it has been the practice to manually place temporary jack supports around the area to be drilled. Alternatively, large cantilevered hydraulically actuated arms may be used to provide some degree of protection to bolter personnel from the possibility of roof falls. The currently employed method and apparatus for accomplishing a bolting operation is slow and tedious on one hand and cumbersome on the other. Bolting still remains the "log" jamming the possible increase in coal extraction, the weakest link in the coal mining operation.

SUMMARY OF THE INVENTION

The present invention is addressed to a portable mine roof drilling apparatus for both drilling holes for roof bolting purposes and providing simultaneous temporary support for the mine roof during such drilling. The apparatus includes a rotatable base upon which is located the drilling mechanism. By rotating the base the drilling station may be positioned in a plurality of positions about the base's pivot point. In a preferred embodiment of the present drilling apparatus, there is provided an indexing mechanism which insures the correct arresting of the base's rotation at four equally spaced locations (one in each quadrant). The resultant four drill holes (assuming the proper radial distancing of the drilling mechanism) are then located four feet from each of the other adjacent holes. The drilling apparatus also includes, as an integral portion thereof, a protective canopy and roof support for protecting the apparatus operator from roof falls and providing the temporary roof to floor support necessary to minimize roof fall during the drilling operation.

The rotatable roof drilling apparatus of the present invention may be formed as an integral part of a roof bolting vehicle or may be formed as an attachment for most any self-powered mining vehicle which can be easily converted to a bolting vehicle. The apparatus, in any case, provides for multiple row drillings whether employed as a single or double unit.

Accordingly, it is a primary object and feature of the present invention to provide a portable roof drilling apparatus capable of drilling a plurality of roof bolting holes from a single position, the apparatus being capable of drilling a plurality of rows of such holes, the rows being oriented normal to the longitudinal path of the mine passage.

It is a general object and feature of the present invention to provide a rotatable roof drilling apparatus adapted to drill a plurality of roof bolting holes both in a lateral and longitudinal direction from a given direction of travel of the apparatus.

It is another general object and feature of the present invention to provide a portable rotatable drilling apparatus adapted to drill eight equally spaced roof bolt holes from a given position, four of the holes being in one row and four in another.

It is an object and feature of the present invention to provide a rotatable roof drill attachment for a standard mining vehicle, the attachment being capable of drilling a plurality of equally spaced roof bolting holes from a given position.

It is another object and feature of the present invention to provide a rotatable roof drill apparatus capable of drilling roof bolting holes equally spaced from a given point and having a support mechanism formed as a portion thereof for providing roof to floor support proximate the apparatus during the drilling operation.

It is yet another object and feature of the present invention to provide a rotatable roof drilling apparatus having a roof support and operator canopy which reduces bolting time in a mine roof.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the annexed claims. The invention itself, however, both as to its structure and its operation together with the additional objects and advantages thereof, will best be understood from the following description of the preferred embodiment of the invention when read in conjunction with the accompanying drawings wherein:

DETAILED DESCRIPTION OF THE INVENTION

Figure 1:
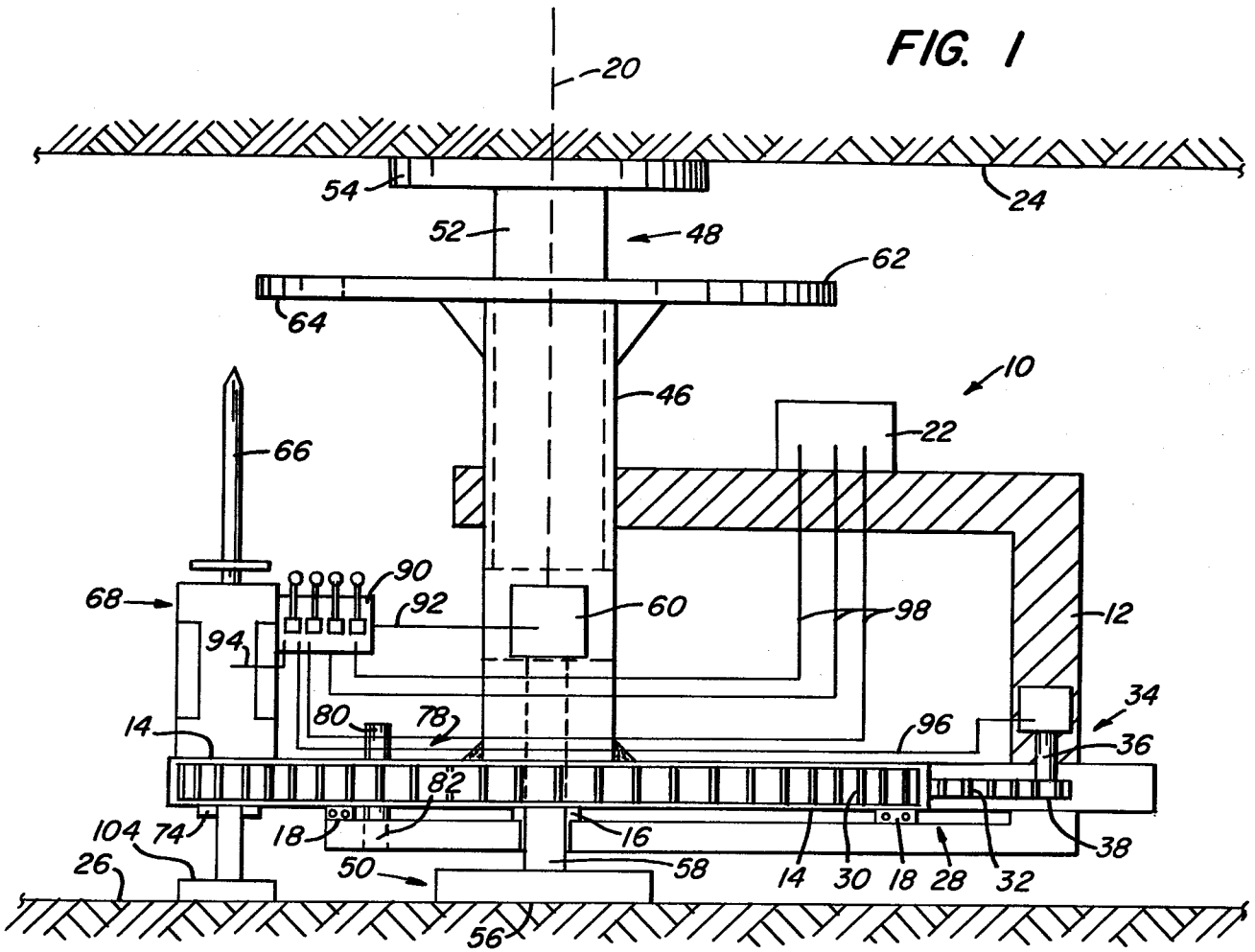
FIG. 1 is a side elevational view of one embodiment of the rotatable roof drilling apparatus of the present invention.

A simplified rotatable roof drilling apparatus for drilling a plurality of holes in a mine roof from a given position is shown in FIG. 1. Referring to FIG. 1, there is shown an elevational diagrammatic view of a roof drilling apparatus 10. The apparatus generally includes a housing 12 for supporting a rotatably mounted base member 14 which provides the necessary rotation for the rotatable roof drilling portion of the apparatus. The rotatably mounted base 14 is journalled through an appropriate pivot or journal 16. Bearings, as at 18, proximate the periphery of base 14 may be provided for supporting the base member 14 in its rotation about an axis of rotation indicated by line 20.

Figure 2:
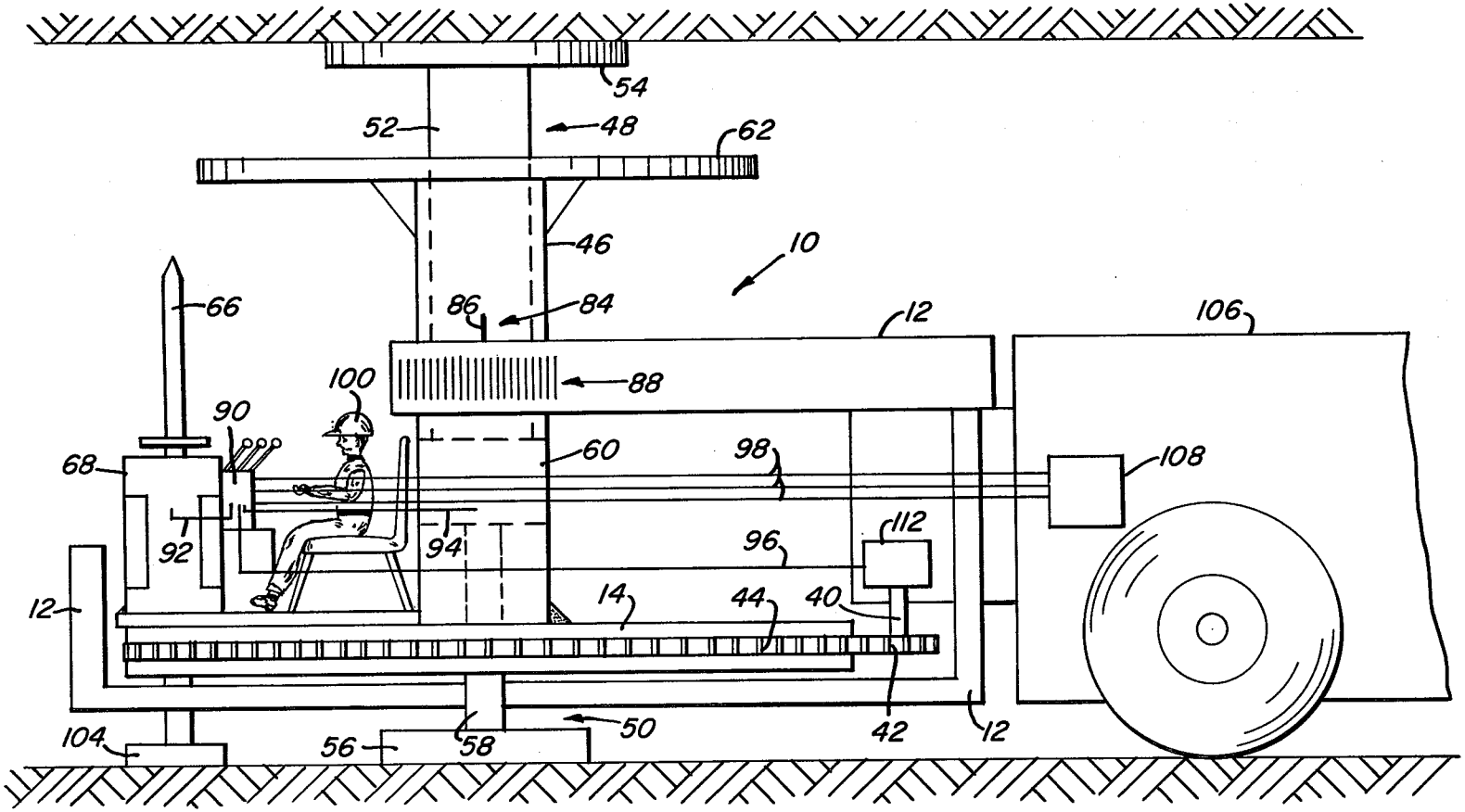
FIG. 2 is a side elevational view of another embodiment of the present invention.

A power source, as at 22, is provided for powering the necessary equipment formed as a part of the apparatus 10 which will be described below. It should be noted that the power source 22 may be of any convenient design or configuration such as electrical, pneumatic, or as provided in the preferred embodiment, hydraulic. One of the functions the power source 22 serves is the provision for rotation of the base member 14 relative to the housing 12, the mine roof 24 and the mine floor 26. This rotation may be effected through any variety of ways such as a motor drive or the like. In the preferred embodiment of the invention, however, rotation of the base member 14 is accomplished through a chain and sprocket arrangement 28. As may be evidenced from FIG. 1, a sprocket 30 is located about the periphery of circular base member 14 which is powered through an appropriately configured chain 32. The chain 32 is, in turn, connected to the power source 22 through a power shaft and sprocket arrangement 34 including a rotational shaft 36 and a small drive sprocket 38. Power from the source 22 is then transferred through the shaft 36 to the small drive sprocket 38 to the chain 32 to the sprocket 30 located about the periphery of the base member 14 for effecting rotation of the same. The power linkage just described may also take the form of a gear drive arrangement as shown in FIG. 2. As indicated therein, a drive shaft 40 is connected to a small drive gear 42 which is, in turn, meshed with a gear 44 lieing about the periphery of the base member 14 for rotating the same.

Extending vertically from the base 14 and attached thereto is a roof support column 46. Column 46 contains the necessary mechanism for providing a temporary support for the mine roof 24 during the drilling operation which will be described below. Mounted for slidable movement within the hollow column 46 are an upper and a lower extendable roof support members, 48 and 50, respectively. The upper support member 48 includes a large center shaft 52 and a relatively flat plate-like portion 54 attached to the top thereof. The plate 54 is engageable with the mine roof 24 and functions to support the mine roof in conjunction with the lower support member 50. The lower roof support member 50 generally includes a pad or foot 56 attached to a vertical shaft 58. The pad or foot 56 is engageable with the mine floor and, in combination with the upper roof support member 48, transfers any downward force on the roof during drilling to the mine floor 26. Both the upper and lower roof support members 48 and 50, respectively, are extendable relative to the static column 46. Extension of the two roof support members is effected, in the preferred embodiment of the present invention, through a hydraulic unit 60 located within the column 46. Thus, the two elements of the roof supporting system may be extended and retracted as the roof drilling apparatus is moved between positions within the mine.

Figure 4:
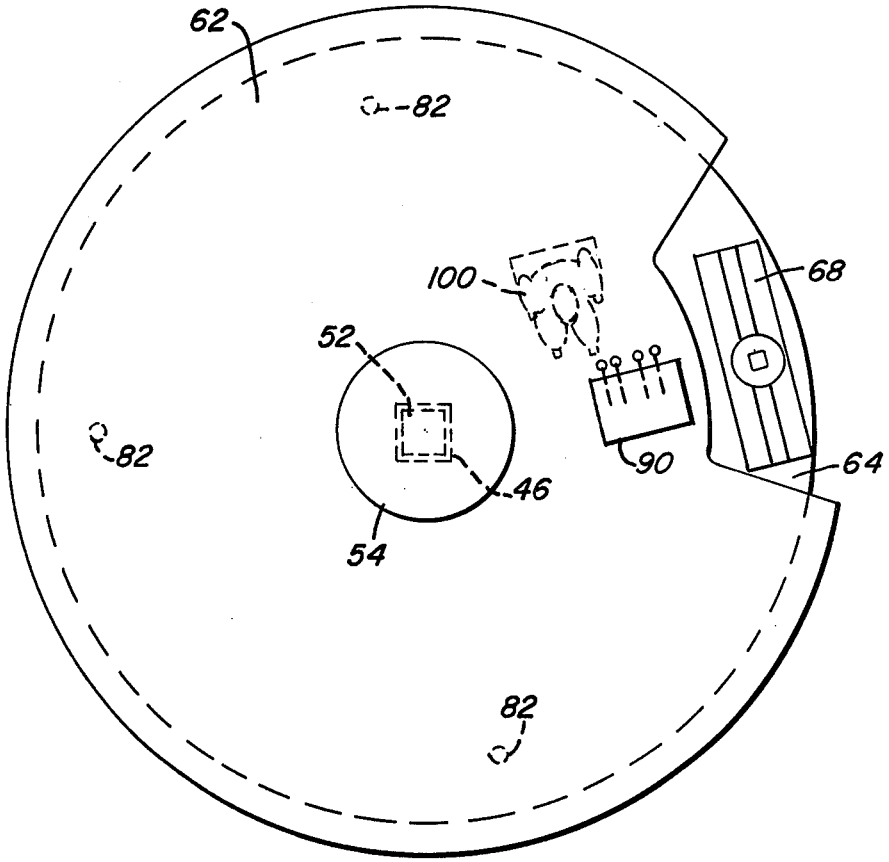
FIG. 4 is a plan view of the roof drilling apparatus of FIG. 1.

The column 46 has an attached canopy 62 which serves to protect the operator of the roof drilling apparatus from any possible roof falls. The canopy 62 is preferably circular, although it may have any appropriate configuration necessary to meet specific requirements within a given situation. The one necessary element which must be included within any protective canopy design is some allowance for passage of the drilling steel to the mine roof. In the embodiment shown in FIG. 1, this is achieved by providing a partial cut-away 64 as best evidenced from FIG. 4. This cut-away allows the drilling steel 66 to pass the drilling unit, indicated at 68, to the mine roof 24. Inasmuch as the drilling unit 68 is attached to the base member 14, as is the canopy through the column 46, there is a co-rotation of the two when the base member 14 is rotated, thereby locating the cut-away 64 directly about the drilling unit 68 at all times.

Figure 5:
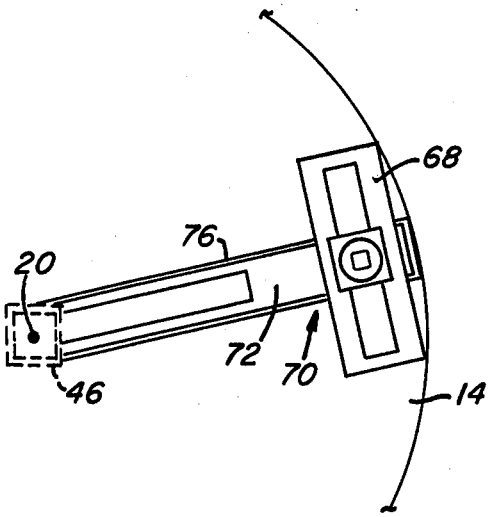
FIG. 5 is a partial top view of the roof drilling apparatus of FIG. 1 showing an alternative feature for the present invention.

The drilling unit 68 is slidably mounted upon the base member 14 for radial inward and outward movement of the unit relative to the base member's axis of rotation 20. This movement permits a changing of the diametrical distancing of drill holes relative to the axis of rotation of the apparatus 10. The specific reasons for this change will be discussed in further detail below. The unit 68, as shown in FIG. 5, is mounted to the base member 14 through a slide arrangement indicated generally at 70. The slide arrangement 70 is configured as an aperture 72 formed in the base member 14 and extending radially outwardly from the pivot axis 20 of the apparatus 10. A portion of the bottom of the drilling unit 68 extends through the aperture 72 and mushrooms out as at 74 to form a keyway in which the sides 76 of the aperture slide. Appropriate locking mechanisms are provided for locking the drilling unit at a given radial distance from the axis of rotation 20 of the apparatus 10. It should be noted in this regard that the "usual" center to center distance of roof bolts is 4 feet. Accordingly, the radial distance of the center of the drilling unit 68 to the axis of rotation would normally be set at 2.828 feet, thus placing diametrically opposed roof holes at center to center distances of 5.66 feet.

In order to effect the drilling of the maximum number of roof bolt holes each of which is distanced four feet from each adjacent hole, it is necessary to effect the drilling of four holes located at 90° from the other. In other words, the four holes must be placed one full quadrant from each other at a radius of drilling of 2.828 feet. Thus, four holes located in two rows are positioned 4 feet from each other (excluding diametrically opposed holes). To insure the proper location of the four holes (or more in other embodiments), it is necessary to index the roof drilling apparatus base member to 90° rotation increments. This is not to suggest that other spacings may not be possible or even practical, but that the preferred embodiment of the present invention employs the use of four drilling locations. Two such indexing mechanisms are shown in FIGS. 1 and 2.

Looking to FIG. 1, there is shown a simple but effective way in which quadrant indexing of the rotatable base is accomplished. In particular, rotation of the base member 14 is stopped at four angularly equally spaced positions through the use of a pin and hole arrangement as at 78. A pin 80, supported by the base 14, is configured to fall into four equally spaced holes 82 located in the housing 12 (see FIG. 4). When the pin 80 engages a hole, rotation of the base member and drilling unit stops and drilling commences. When one hole is drilled, the pin is disengaged from the hole and the base is rotated until the pin engages another locating hole in the housing. Another embodiment of an indexing arrangement is indicated generally at 84 in FIG. 2. Simply stated, the second indexing arrangement includes an indicator 86 located on a portion of the roof support column 46 and a plurality of angular indexing marks 88 located on a portion of the housing 12 in proximity to the column 46 as shown in FIG. 2. The amount of rotation of the base member 14 and the drilling unit 68 may be easily gauged by making reference to the angular indexing marks 88.

Power to effect the rotation of the base member 14, to power the drilling unit 68 and to operate the hydraulic unit 60 for extending and retracting the upper and lower roof support elements comes from the power source 22. In order to correctly operate the apparatus 10, it is necessary to first connect the power source through a control unit shown at 90 via power lines at 98. The control unit 90, in turn, is connected to each of the units requiring power through control power lines at 92, 94 and 96 which are connected to the hydraulic unit 60, the drilling unit 68, and the drive unit for rotation of the base member 14, respectively. In this manner each of the operations of rotating, drilling and roof support actuation may be easily controlled.

Figure 3:
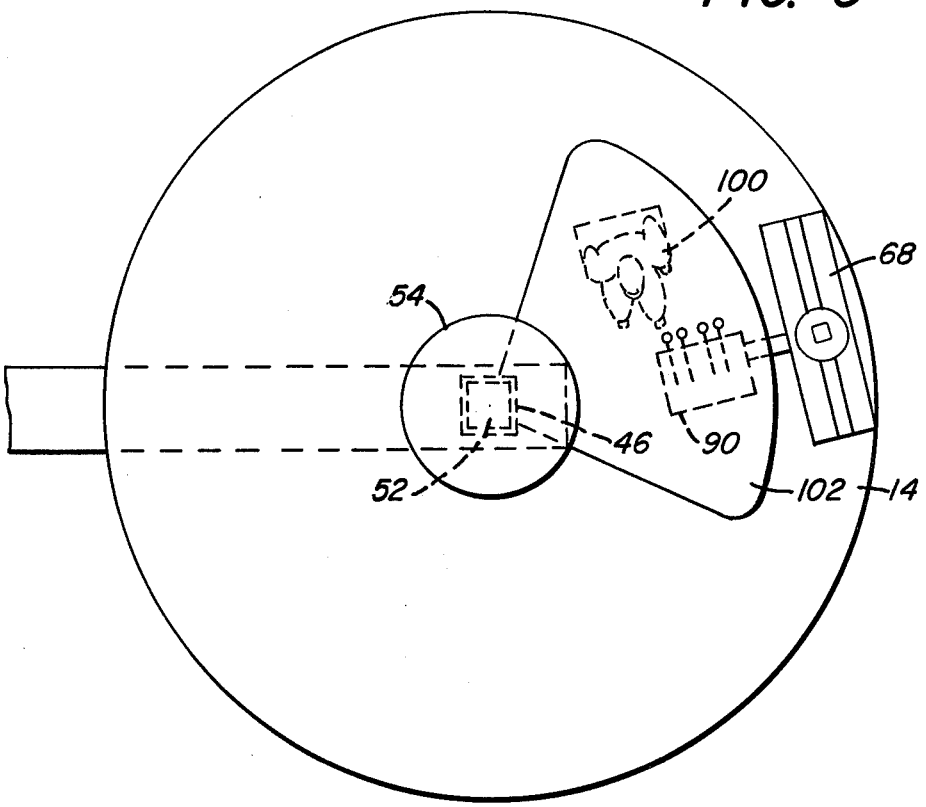
FIG. 3 is a plan view of the roof drilling apparatus of FIG. 1 showing one alternative embodiment.

Shown in FIG. 3 is an alternate embodiment of a protective canopy for the operator 100 who controls the roof drilling apparatus 10. Instead of a complete circular canopy, the canopy 102 shown in FIG. 3 is configured as a pie-shaped segment attached to the roof support column 46 as was the circular canopy 62. The segmented canopy 102 is rotatable with the base member 14 and drilling unit 68 such that the relationship between all three (and the operator 100) remains the same as that shown in FIG. 3. Accordingly, the operator 100 is constantly protected from roof falls without the necessity for a cut-away portion to be included in the canopy.

The drilling unit 68 which is mounted upon the base member 14 provides the necessary upward thrust (up to approximately 20,000 pounds) to the drill steel 66. The unit of the preferred embodiment is configured having a centered drill box which is telescoped upwardly to provide a constant thrust to the mine roof through its upward travel. The centered drill box and telescoping drilling unit 68 is described and claimed in a copending application for U.S. patent entitled "Centered Drill Head Apparatus" by Walter Hood and Joseph Subrick, Ser. No. 687,113, filed simultaneously herewith and assigned to the assignee of the present application.

In order to provide a counter support for the downward resultant force due to the thrust exerted by the drilling unit 68, there is additionally provided on base member 14 a downwardly depending retractable foot 104. Foot 104 transfers, when in its downwardly extended state in which it engages the mine floor 26, the force from the drilling unit 68 to the mine floor. As a result, the downwardly directed force due to the upwardly directed thrust from the drilling unit is transferred directly to the mine floor 26.

It should be apparent that the rotatable roof drilling apparatus described relative to FIG. 1 includes no specific means for transferring the apparatus from one mine location to another. Consequently, the remaining embodiments relate, at least indirectly, to locomotive elements for the apparatus per se. In this regard attention should be directed to FIGS. 2, 6, 7 and 9.

Figure 8:
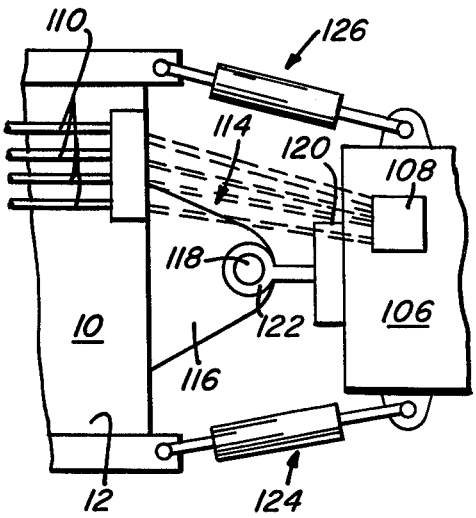
FIG. 8 is another embodiment of the roof drilling apparatus of the present invention.

As may be evidenced from FIG. 2, the rotatable roof drilling apparatus of the present invention is shown in combination with a "standard" mining vehicle. It is important to note that the roof drilling apparatus described above may be attached to most any convenient vehicle employed within the mine so long as it is self-powered and readily maneuverable within a mine environment. In the embodiment shown in FIG. 2, the rotatable roof drilling apparatus 10 is combined with a standard "bolter" vehicle with the former bolting apparatus removed. The apparatus 10 is attached to the vehicle 106 through the housing 12. The connection between the apparatus 10 and the vehicle may be rigid, as shown in FIG. 2, or it may be an articulated connection as shown in FIG. 8. The details of articulating the roof drilling apparatus to a vehicle will be discussed in more specific detail below with regard to FIG. 8. The vehicle 106 includes, in addition to the normal locomotive elements, a power supply 108 for providing power to the necessary energy requiring elements of the vehicle. The power supply 108 is connected to the control unit 90 of the apparatus 10 through a plurality of power lines 110 which are complementarily configured to the specific type of power source located on the vehicle. From the control unit 90 the lines 92, 94 and 96 are connected to the power requiring elements 68, 60, and the rotating drive unit 112 located on the apparatus.

Attachment of the apparatus 10 to the vehicle 106 may be made by welding, bolting or the like if a rigid connection between the two is desired. However, due to the frequent necessity for maneuverability within the close quarters provided in a mine, articulation of the roof drilling apparatus relative to the vehicle may well be desirable and even necessary. Looking to FIG. 8, there is shown one embodiment of an articulation connection. Specifically, the apparatus 10 has attached thereto a post and support assembly 114 including a planar support member 116 and a vertical pin or post 118. The vehicle 106 has a support member 120 connected to its structure, the support member having a circular yoke 122 located at its end for capturing the pin 118 and providing for relative angular articulative motion of one element relative to the other. For this purpose wheels, slides or the equivalent (not shown) might be placed upon the apparatus for facilitating its manipulation. Automatic articulative movement of the apparatus 10 relative to the vehicle 106 may be accomplished by providing two hydraulic actuation assemblies 124 and 126 on either side of the vehicle and assembly as shown in FIG. 8. Retraction of one hydraulic unit and a simultaneous extension of the other would achieve the desired "turning" of the assembly 10 relative to the vehicle as is well known in the art. Such hydraulic articulation systems are currently available and used within mining environments.

Figure 7:
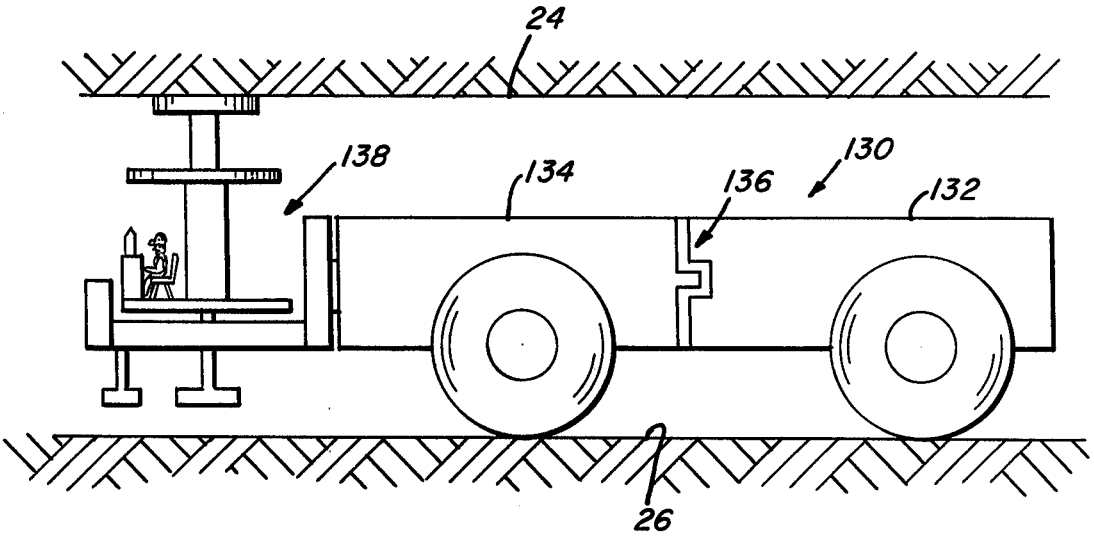
FIG. 7 is a side elevational view of the roof drilling vehicle of FIG. 6.
Figure 6:
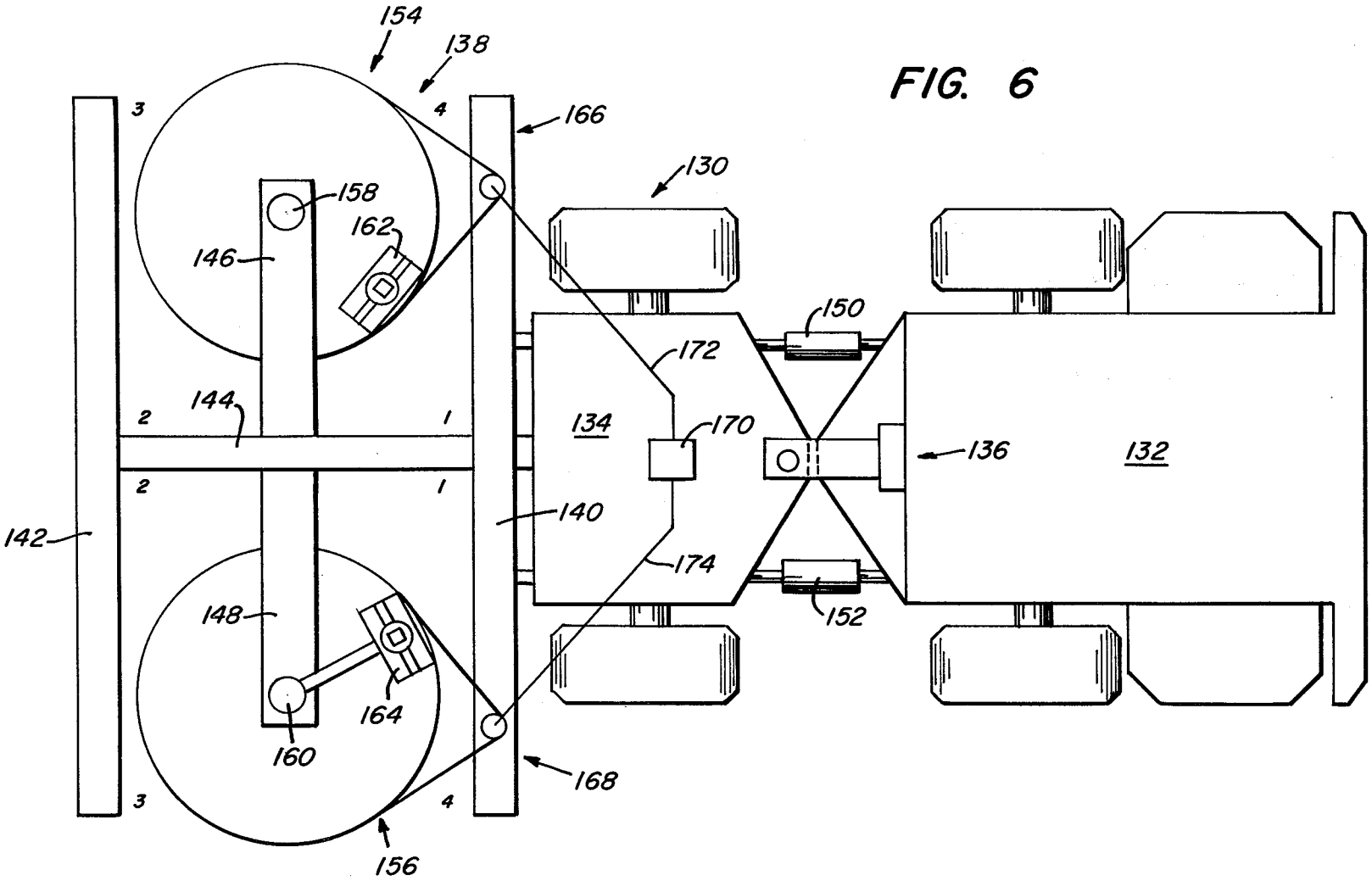
FIG. 6 is a plan view of a roof drilling vehicle according to the present invention.
Figure 9:
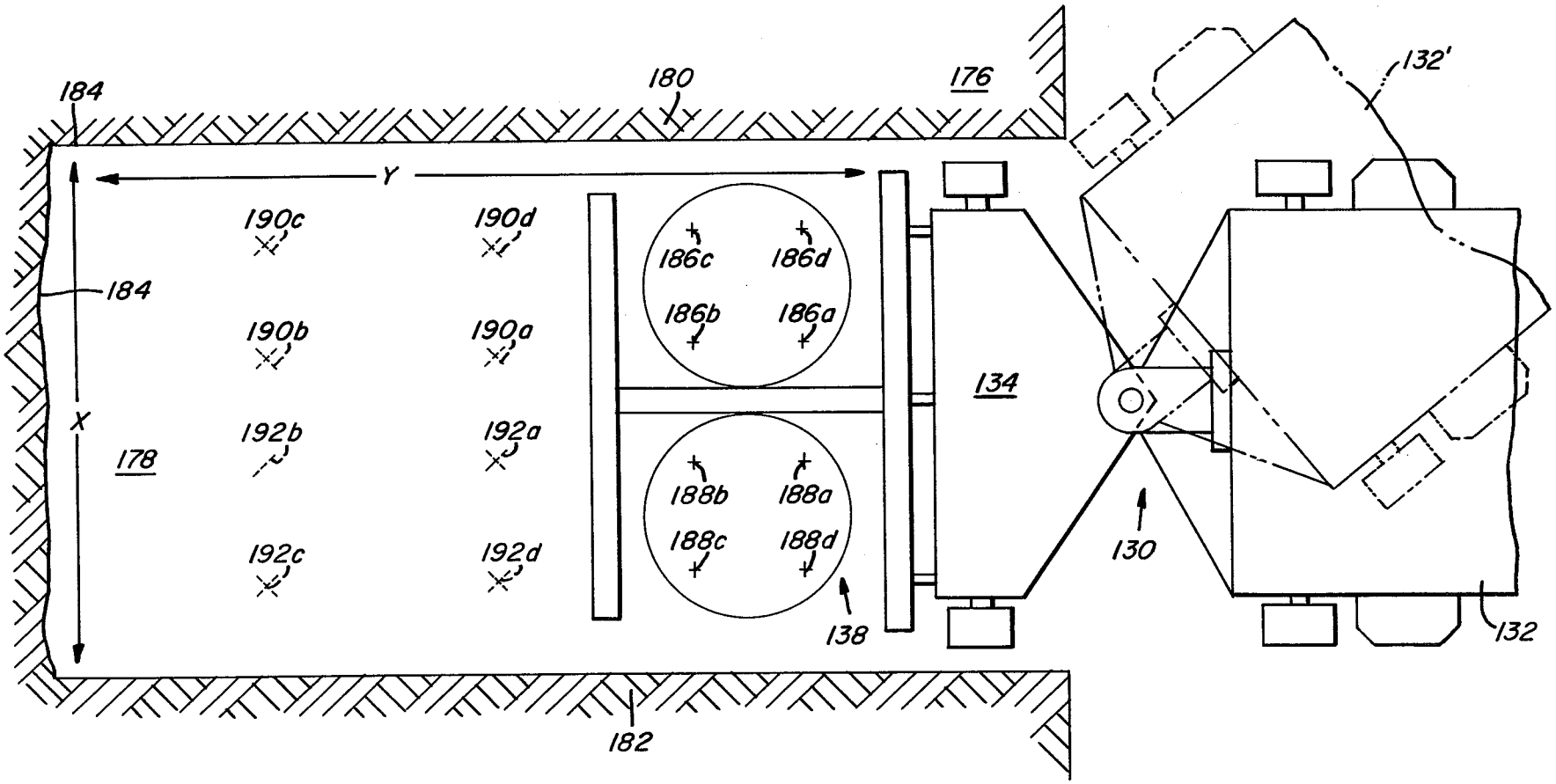
FIG. 9 is a plan view of a portion of a mine showing one embodiment of the present invention located therein.

Another embodiment of the present invention incorporating multiple roof drilling units on a single mining vehicle is shown relative to FIGS. 6, 7 and 9. Looking to those specific Figures, there is shown a rotatable roof drilling vehicle 130 which is capable of drilling a pluraity of, and preferably eight, roof holes located in two rows from a given position of the vehicle 130 within the mine. The vehicle 130 is preferably configured having a two-section body (although a single-section chassis may be employed) which is articulated for ease of maneuverability within the mine. The vehicle has rear and forward sections 132 and 134, respectively, which are articulated to each other at 136 in a manner previously described. In this regard, hydraulic actuation units as at 150 and 152 are provided for permitting "automatic" articulation of the vehicle through its two sections 132 and 134. Attached to the front of forward section 134 is a dual rotatable roof drilling assembly 138 according to the present invention. The assembly 138 is configured having a generally H-shaped housing comprised of three main structural members 140, 142 and 144 and two additional extension members 146 and 148. The assembly 138 is attached to the front of section 134 through structural member 140 by any convenient suitable means (not shown). The vehicle 130 is self-powered by a source (not shown) which is, in part, employed to provide the necessary energy for a variety of functions. Inasmuch as the tramming or moving of the vehicle occurs during non-drilling operations, and drilling only takes place during times when the vehicle 130 is stationary, it is convenient as well as efficient to utilize a power switching network which may be used for the non-simultaneous operations of drilling and tramming. Such a system or power utilization network is disclosed and claimed in a copending application for U.S. patent entitled "Hydraulic Flow Divider for a Mining Vehicle" by Joseph Subrick, Ser. No. 686,963, filed simultaneously herewith and assigned to the assignee of the present application. For a more detailed explanation of the manner in which power switching may occur, reference should be made to the above-noted application.

Mounted to each of the extension members 146 and 148 are rotatable roof drilling units, canopies, and related equipment previously described with regard to FIGS. 1–5. Such description of the elements will not be repeated here for purposes of brevity. Each of the rotatable drilling units, as at 154 and 156 has an associated pivot point 158 and 160, respectively, located on extensions 146 and 148, respectively. Each of the drilling assemblies 154 and 156 is rotatable approximately 270° from positions numbered "1" through the positions numbered "4" and back. Configured as such, each of the drilling assemblies position their associated drilling units 162 and 164, respectively, at four quadrant locations as the numbers "1" through "4" indicate. Each drilling assembly 154 and 156 is rotated through either a chain and sprocket drive or a gear drive as described above. In the preferred embodiment, two sprocket and chain drive assemblies 166 and 168, associated with assemblies 154 and 156, respectively, are employed to drive the rotatable roof drilling units between their various positions. The power source 170 of the vehicle is employed to drive each of the sprocket and chain drives as is schematically indicated at 172 and 174. The specific details of how the power source 170 of the vehicle is connected to the various components is either commonly known in the art or is described in the aforementioned application for U.S. patent entitled "Hydraulic Flow Divider for a Mining Vehicle".

Looking to FIG. 9, the roof bolting vehicle 130 of FIGS. 6 and 7 is shown in place in a mine bolting situation proximate a corner 176 and entering a mine passage 178 formed from two side walls or ribs 180 and 182 and the mine face 184. A portion of the bolter 130 is shown in phantom at 132' to indicate how articulation aids in maneuvering the vehicle within a mine. Under a "normal" mining situation, a coal mining machine will proceed down the mine passage (in effect making the mine passage) until it has mined a passage having a given width "*x*" and a length "*y*". The width "*x*" is usually between 16 and 20 feet while the length of unbolted roof permissible is 20 feet (the distance between the miner operator and the front of the miner). When the mining machine has accomplished this, it retreats and a bolting machine begins to drill holes within the mine roof for mine roof bolting purposes. (This is because the miner operator may not work under non-supported roof; in this case 20 feet.) For instance, the bolting machine of the present invention has entered the passage 178 and has begun to drill eight holes indicated **186*a–d* and 188*a–d*** in two rows of four each. In most instances, the distance between adjacent roof holes in 4 feet as is required by law. However, it may be necessary or preferable to drill at lesser and, if legally permissible, greater bolt to bolt distances. The radial adaptability of the drilling unit relative to the base member has been discussed relative to FIG. 5.

It should be noted that the roof drilling vehicle 130 is capable of drilling two rows of four bolts each from a given position. Due to all the necessary actuation and subsequent retraction of mine roof supports and supports under the drilling unit per se, it should be apparent that the less moving of a machine the better. Once the machine 130 has drilled the two pairs of four indexed holes, it moves up into the mine passage 8 feet (assuming 4 feet between rows) to drill the holes 190*a–d* and 192*a–d* from a new position. When the roof drilling and bolting operations have been completed (the latter being accomplished through conventional practices), the bolting vehicle is withdrawn from the passageway and the miner is moved therein to begin a continuation of the passage.

It should become apparent that the rotatable roof drilling apparatus of the present invention, whether configured singly or in tandem, serve to facilitate the mine roof drilling and bolting operation. Inasmuch as this operation is the "weak link" in mining operations today, it is both economically and practically sound to incorporate a machine for increasing the efficiency of such operations. The rotatable roof drilling apparatus of the present invention serves to decrease the bolting operation while substantially increasing the safety provided for the operator of the machine as well as all mine personnel associated in an unsupported mine passageway during a slow and tedious bolting operation. The apparatus provides for a simplified roof drilling apparatus long needed in the heretofore complicated and slow mining operation.

Accordingly, while certain changes may be made in the above-noted apparatus and vehicles without departing from the scope of the invention herein involved, it is intended that all matter contained in the above description or shown in the accompanying drawings shall be interpreted as illustrative and not in a limiting sense.

We claim:

1. A rotatable roof drilling apparatus for drilling multiple holes in a mine roof from a given position, said rotatable roof drilling apparatus comprising:

a housing;

a base connected to a portion of said housing and adapted to be rotated about a given pivot relative to the mine roof and floor;

a roof support, connected to said base, having an upper portion adapted to be moved into engagement with the mine roof and a lower portion adapted to be moved into engagement with the mine floor for providing support between the mine floor and roof;

means for moving said upper portion of said roof support into engagement with the mine roof and the lower portion of said roof support into engagement with the mine floor;

drilling means for drilling holes in said mine roof, said drilling means being positioned on said base and movable with said base as said base is rotated about its said given pivot;

downwardly extending retractable support means, located on said base under said drilling means for transferring thrust from said drilling means to the mine floor during the time that upward drilling force is applied by said drilling means;

power means for rotating said base about its pivot so as to move said drilling means in a circular locus of travel between a plurality of positions at which holes may be bored into the mine roof; and protective canopy means, formed as a portion of said base, for protecting an operator of said apparatus located on said base during drilling.

2. The rotatable roof drilling apparatus of claim 1 in which said rotatable roof drilling apparatus also includes means for indexing the rotation of said base means at four equally spaced positions such that said drilling means may drill four equally spaced holes.

3. The rotatable roof drilling apparatus of claim 1 in which said means for rotating said base about its pivot includes gear means formed on said base means engageable with driving gear means associated with said housing for rotating said base about its pivot through said gear means.

4. The rotatable roof drilling apparatus of claim 1 in which said means for rotating said base about its pivot includes spocket means formed about said base and chain means, in engagement with said sprocket means for driving said sprocket means and said base from a power source included as a further portion of said rotatable roof drilling apparatus.

5. The rotatable roof drilling apparatus of claim 1 in which said rotatable roof drilling apparatus further includes means for permitting radial inwardly and outwardly movement of said drilling means on said base for decreasing and increasing, respectively, the separation of holes drilled for a given number of equally spaced locations from each other.

6. A rotatable roof drilling apparatus for drilling multiple holes in a mine roof from a given position, said rotatable roof drilling apparatus comprising:

a housing;

a base connected to a portion of said housing and adapted to be rotated about a given pivot relative to the mine roof and floor;

a roof support, connected to said base, having an upper portion adapted to be moved into engagement with the mine roof and a lower portion adapted to be moved into engagement with the mine floor for providing support between the mine floor and roof;

means for moving said upper portion of said roof support into engagement with the mine roof and the lower portion of said roof support into engagement with the mine floor;

drilling means for drilling holes in said mine roof, said drilling means being positioned on said base and movable with said base as said base is rotated about its said given pivot, said base being rotatable a total of 270° for permitting the drilling of four holes by said drilling means from four different quadrant locations;

power means for rotating said base about its pivot so as to move said drilling means in a circular locus of travel between a plurality of positions at which holes may be bored into the mine roof; and protective canopy means, formed as a portion of said base, for protecting an operator of said apparatus located on said base during drilling.

7. A portable roof drilling vehicle for drilling at least two holes in a mine roof from a given position comprising:

a powered vehicle movable from one location to another and having supporting means thereon;

a base member connected to said supporting means of said powered vehicle, said base member being rotatable about a given pivot point relative to said supporting means, said mine roof and said mine floor;

a roof support, connected to said base member, said roof support having upper and lower portions adapted to be moved into engagement with the mine roof and floor, respectively, for supporting a portion of such mine roof proximate said drilling vehicle;

drilling means for drilling holes in said mine roof, said drilling means being located on said base and movable therewith as said base is rotated about its given pivot;

means for moving said upper and lower portions of said roof support into their respective engagements with the mine roof and floor;

means for powering said drilling means;

downwardly extending retractable support means, located on said base under said drilling means, for transferring thrust from said drilling means to the mine floor during the time that upward drilling force is applied by said drilling means;

power means for rotating said base about its given pivot point for causing the movement of said drilling means between a plurality of positions at which holes may be drilled into the mine roof without movement of said portable drilling vehicle; and protective canopy means, formed as a portion of said housing, for protecting an operator of said vehicle located on said base member during drilling.

8. The portable roof drilling vehicle of claim 7 in which said portable roof drilling vehicle also includes means for indexing the rotation of said base member at four equally angularly-spaced positions such that said drilling means may drill four equally spaced holes.

9. The portable roof drilling vehicle of claim 7 in which said means for rotating said base about its pivot includes gear means formed on said base member engageable with driving gear means associated with said supporting means and said vehicle for rotating said base about its pivot through said gear means.

10. The portable roof drilling vehicle of claim 7 in which said means for rotating said base member about its pivot includes sprocket means formed about said base member and chain means, in engagement with said sprocket means for driving said sprocket means and said base member from a power source included as a further portion of said portable roof drilling vehicle.

11. The portable roof drilling vehicle of claim 7 in which said base member includes means for rotationally supporting an operator upon said base member.

12. The portable roof drilling vehicle of claim 7 in which said portable roof drilling vehicle further includes means for permitting radial inwardly and outwardly movement of said drilling means on said base member for decreasing and increasing, respectively, the separation of holes drilled for a given number of equally spaced locations from each other.

13. The portable roof drilling vehicle of claim 7 in which said base member is articulated to the support means of said powered vehicle for aiding in the manipulation of said portable roof drilling vehicle around corners.

14. A portable roof drilling vehicle adapted to drill at least four holes in a mine roof from a given position comprising:

a powered vehicle movable from one location to another;

support means attached to said vehicle and extending outwardly therefrom toward a convenience roof drilling location relative to said vehicle;

a first turntable member connected to said support means and being rotatable relative thereto about a given pivot point;

a second turntable member connected to said support means and being rotatable relative thereto about another given pivot point, said second turntable member being separated from said first turntable member a given distance such that substantially equal spacing of the drill holes in the roof may be effected when each of the two turntable members are rotated about their pivots with a given radius;

first drilling means located on said first turntable member and rotatable therewith for drilling circularly patterned holes in such mine roof relative to said given pivot point;

second drilling means located on said second turntable member and rotatable therewith for drilling a second set of circularly patterned holes in such mine roof relative to said another given pivot point, each of said turntable members being rotatable a total of 270° about their respective pivots for permitting the drilling of four holes by said drilling means from four different quadrant locations without movement of said portable roof drilling vehicle;

roof support means, associated with each of said turntable members, having upper and lower portions adapted to be moved into engagement with the mine roof and mine floor, respectively, for supporting a portion of such mine roof proximate said vehicle;

means for moving said upper and lower portions of said roof support means into their respective engagements with the mine roof and mine floor;

means for powering said first and second drilling means;

power means for rotating said first and second turntable members about their respective pivot points for causing movement of said first and second drilling means between a plurality of positions at which holes may be drilled into the mine roof without movement of said portable roof drilling vehicle; and operator protection means including a pair of protective canopies attached to a portion of said roof support means for protecting an operator located on said first and second turntable members during drilling.

15. The portable roof drilling vehicle of claim 14 in which said portable roof drilling vehicle also includes means for indexing the rotation of each of said first and second turntable members at four equally spaced positions such that each of said drilling means may drill four equally spaced holes relative to each turntable member.

16. The portable roof drilling vehicle of claim 14 in which said portable roof drilling vehicle further includes means for permitting radial inwardly and outwardly movement of said drilling means on said turntable members for decreasing and increasing, respectively, the separation of holes drilled for a given number of equally spaced locations from each other relative to each turntable member.

17. The portable roof drilling vehicle of claim 14 in which said support means is articulated to said portable roof drilling vehicle for aiding in the manipulation of said portable roof drilling vehicle around corners in a mine.

18. A roof drilling attachment for a mining vehicle having an associated power supply, said roof drilling attachment comprising:

a housing, having means for physically attaching said roof drilling attachment to such mining vehicle, said roof drilling attachment being movable with such mining vehicle;

base means, connected to a portion of said housing and adapted to be rotated about a given pivot relative to the mine roof, the mine floor, and said housing;

roof support means, attached to said base, having an upper portion adapted to be moved into engagement with such mine roof and a lower portion adapted to be moved into engagement with the mine floor for providing support between the mine floor and roof;

means for moving said upper portion of said roof support into engagement with such mine roof and the lower portion of said roof support into engagement with such mine floor;

drilling means, positioned on said base and rotatable therewith as said base is rotated about its given pivot point, for drilling holes in said mine roof;

downwardly extending retractable support means, located on said base under said drilling means, for transferring thrust from said drilling means to the mine floor during the time that upward drilling force is applied by said drilling means;

means for providing power to said means for moving the upper and lower portions of said support means and to said drilling means;

means for rotating said base means about its pivot so as to move said drilling means in a circular path of travel between a plurality of positions at which holes may be drilled into the mine roof; and protective canopy means, attached to a portion of said roof support, for protecting the operator located on said attachment during drilling.

19. The roof drilling attachment of claim 18 in which said roof drilling attachment also includes means for indexing the rotation of said base means at four equally angularly-spaced positions such that said drilling means may drill four equally spaced holes.

20. The roof drilling attachment of claim 18 in which said means for rotating said base means about its pivot includes gear means formed on said base means engageable with driving gear means associated with said housing for rotating said base means about its pivot through said gear means.

21. The roof drilling apparatus of claim 18 in which said means for rotating said base means about its pivot includes sprocket means formed about said base means and chain means, in engagement with said sprocket means for driving said sprocket means and said base means from a power source associated with such mining vehicle through means for connecting such power source to said chain means.

22. The roof drilling apparatus of claim 18 in which said base means includes means for rotationally supporting an operator upon said attachment.

23. The roof drilling apparatus of claim 18 in which said roof drilling apparatus further includes means for permitting radial inwardly and outwardly movement of said drilling means on said base means for decreasing and increasing, respectively, the separation of holes drilled for a given number of equally spaced locations from each other.

24. The roof drilling apparatus of claim 18 in which said attaching means, formed as a portion of said housing, includes means for articulatively connecting said roof drilling apparatus to such mining vehicle.

25. The roof drilling apparatus of claim 18 in which said roof drilling apparatus includes means for connecting the power source of said mining vehicle to said roof drilling apparatus for powering the moving means, the drilling means and said means for rotating said base.

26. A rotatable roof drilling apparatus for drilling multiple holes in a mine roof from a given position, said rotatable roof drilling apparatus comprising:

a housing;

a base connected to a portion of said housing and adapted to be rotated about a given pivot relative to the mine roof and floor;

a roof support, connected to said base, having an upper portion adapted to be moved into engagement with the mine roof and a lower portion adapted to be moved into engagement with the mine floor for providing support between the mine floor and roof;

means for moving said upper portion of said roof support into engagement with the mine roof and the lower portion of said roof support into engagement with the mine floor;

drilling means for drilling holes in said mine roof, said drilling means being positioned on said base and movable with said base as said base is rotated about its said given pivot;

means for rotating said base about its pivot so as to move said drilling means in a circular locus of travel between a plurality of positions at which holes may be bored into the mine roof; and protective canopy means, formed as a portion of said base, for protecting an operator of said apparatus located on said base during drilling, said protective canopy means being configured as a wedge-shaped member located directly between the mine roof and the operator, said wedge-shaped member being rotatable with said base for protecting the operator from roof fall in any position of rotation of said base.

27. A rotable roof drilling apparatus for drilling multiple holes in a mine roof from a given position, said rotatable roof drilling apparatus comprising:

a housing;

a base connected to a portion of said housing and adapted to be rotated about a given pivot relative to the mine roof and floor;

a roof support, connected to said base, having an upper portion adapted to be moved into engagement with the mine roof and a lower portion adapted to be moved into engagement with the mine floor for providing support between the mine floor and roof;

means for moving said upper portion of said roof support into engagement with the mine roof and the lower portion of said roof support into engagement with the mine floor;

drilling means for drilling holes in said mine roof, said drilling means being positioned on said base and movable with said base as said base is rotated about its said given pivot;

means for rotating said base about its pivot so as to move said drilling means in a circular locus of travel between a plurality of positions at which holes may be bored into the mine roof; and protective canopy means, formed as a portion of said base, for protecting an operator of said apparatus located on said base during drilling, said protective canopy being configured having a generally circular shape and is located between the mine roof and the operator, said circular canopy being rotatable through its approximate center along with said base and having an aperture formed therein for permitting passage of said drilling means from said base to such mine roof for drilling such mine roof while protecting said operator from falls above.

28. A rotatable roof drilling apparatus for drilling multiple holes in a mine roof from a given position, said rotatable roof drilling apparatus comprising:

a housing;

a base connected to a portion of said housing and adapted to be rotated about a given pivot relative to the mine roof and floor;

a roof support, connected to said base, having an upper portion adapted to be moved into engagement with the mine roof and floor for providing support between the mine floor and roof, said upper portion of said roof support being formed as a generally circular protective canopy;

means for moving said upper portion of said roof support into engagement with the mine roof and the lower portion of said roof support into engagement with the mine floor;

drilling means for drilling holes in said mine roof, said drilling means being positioned on said base and movable with said base as said base is rotated about its said given pivot, said circular protective canopy having a diameter slightly less than twice the distance of the drilling means from the pivot point of the base upon which it is located; and means for rotating said base about its pivot so as to move said drilling means in a circular locus of travel between a plurality of positions at which holes may be bored into the mine roof.

29. A portable roof drilling vehicle for drilling at least two holes in a mine roof from a given position comprising:

a powered vehicle movable from one location to another and having supporting means thereon;

a base member connected to said supporting means of said powered vehicle, said base member being rotatable about a given pivot point relative to said supporting means, said mine roof and said mine floor;

a roof support, connected to said base member, said roof support having upper and lower portions adapted to be moved into engagement with the mine roof and floor, respectively, for supporting a portion of such mine roof proximate said drilling vehicle;

drilling means for drilling holes in said mine roof, said drilling means being located on said base and movable therewith as said base is rotated about its given pivot;

means for moving said upper and lower portions of said roof support into their respective engagements with the mine roof and floor;

means for powering said drilling means;

power means for rotating said base about its given pivot point for causing the movement of said drilling means between a plurality of positions at which holes may be drilled into the mine roof without movement of said portable drilling vehicle; and protective canopy means, formed as a portion of said base, for protecting an operator of said vehicle located on said base member during drilling, said protective canopy being formed as a wedge-shaped member located directly between the mine roof and the operator, said wedge-shaped member being rotatable with said base member for protecting the operator from roof fall in any position of rotation of said base member.

30. A portable roof drilling vehicle for drilling at least two holes in a mine roof from a given position comprising:

a powered vehicle movable from one location to another and having supporting means thereon;

a base member connected to said supporting means of said powered vehicle, said base member being rotatable about a given pivot point relative to said supporting means, said mine roof and said mine floor;

a roof support, connected to said base member, said roof support having upper and lower portions adapted to be moved into engagement with the mine roof and floor, respectively, for supporting a portion of such mine roof proximate said drilling vehicle;

drilling means for drilling holes in said mine roof, said drilling means being located on said base and movable therewith as said base is rotated about its given pivot;

means for moving said upper and lower portions of said roof support into their respective engagements with the mine roof and floor;

means for powering said drilling means;

power means for rotating said base about its given pivot point for causing the movement of said drilling means between a plurality of positions at which holes may be drilled into the mine roof without movement of said portable drilling vehicle; and protective canopy means, formed as a portion of said base, for protecting an operator of said vehicle located on said base member during drilling, said protective canopy being formed having a generally circular shape and is located between the mine roof and the operator, said circular canopy being rotatable through its approximate center along with said base member and having an aperture formed therein for permitting passage of said drilling means from said base member to such mine roof for drilling such mine roof while protecting said operator from falls above.

31. A portable roof drilling vehicle adapted to drill at least four holes in a mine roof from a given position comprising:

a powered vehicle movable from one location to another;

support means attached to said vehicle and extending outwardly therefrom toward a convenience roof drilling location relative to said vehicle;

a first turntable member connected to said support means and being rotatable relative thereto about a given pivot point;

a second turntable member connected to said support means and being rotatable relative thereto about another given pivot point, said second turntable member being separated from said first turntable member a given distance such that substantially equal spacing of the drill holes in the roof may be effected when each of the two turntable members are rotated about their pivots with a given radius;

first drilling means located on said first turntable member and rotatable therewith for drilling circularly patterned holes in such mine roof relative to said given pivot point;

second drilling means located on said second turntable member and rotatable therewith for drilling a second set of circularly patterned holes in such mine roof relative to said another given pivot point;

roof support means, associated with each of said turntable members, having upper and lower portions adapted to be moved into engagement with the mine roof and mine floor, respectively, for supporting a portion of such mine roof proximate said vehicle;

means for moving said upper and lower portions of said roof support means into their respective engagements with the mine roof and mine floor;

means for powering said first and second drilling means;

means for rotating said first and second turntable members about their respective pivot points for causing movement of said first and second drilling means between a plurality of positions at which holes may be drilled into the mine roof without movement of said portable roof drilling vehicle; and downwardly extending retractable support means, located on each turntable member under said drilling means, for transferring thrust from said drilling means to the mine floor during the time that upward drilling force is applied to said drilling means.

32. A roof drilling attachment for a mining vehicle having an associated power supply, said roof drilling attachment comprising:

a housing, having means for physically attaching said roof drilling attachment to such mining vehicle, said roof drilling attachment being movable with such mining vehicle;

base means, connected to a portion of said housing and adapted to be rotated about a given pivot relative to the mine roof, the mine floor, and said housing;

roof support means, attached to said base, having an upper portion adapted to be moved into engagement with such mine roof and a lower portion adapted to be moved into engagement with the mine floor for providing support between the mine floor and roof;

means for moving said upper portion of said roof support into engagement with such mine roof and the lower portion of said roof support into engagement with such mine floor;

drilling means, positioned on said base and rotatable therewith as said base is rotated about its given pivot point, for drilling holes in said mine roof;

means for providing power to said means for moving the upper and lower portions of said support means and to said drilling means;

means for rotating said base means about its pivot so as to move said drilling means in a circular path of travel between a plurality of positions at which holes may be drilled into the mine roof; and protective canopy means, attached to a portion of said roof support, for protecting the operator located on said attachment during drilling, said protective canopy being formed as a wedge-shaped member located directly between the mine roof and the operator, said wedge-shaped member being rotatable with said base means for protecting the operator from roof fall in any position of rotation of said base means.

33. A roof drilling attachment for a mining vehicle having an associated power supply, said roof drilling attachment comprising:

a housing, having means for physically attaching said roof drilling attachment to such mining vehicle, said roof drilling attachment being movable with such mining vehicle;

base means, connected to a portion of said housing and adapted to be rotated about a given pivot relative to the mine roof, the mine floor, and said housing;

roof support means, attached to said base, having an upper portion adapted to be moved into engagement with such mine roof and a lower portion adapted to be moved into engagement with the mine floor for providing support between the mine floor and roof;

means for moving said upper portion of said roof support into engagement with such mine roof and the lower portion of said roof support into engagement with such mine floor;

drilling means, positioned on said base and rotatable therewith as said base is rotated about its given pivot point, for drilling holes in said mine roof;

means for providing power to said means for moving the upper and lower portions of said support means and to said drilling means;

means for rotating said base means about its pivot so as to move said drilling means in a circular path of travel between a plurality of positions at which holes may be drilled into the mine roof; and protective canopy means, attached to a portion of said roof support, for protecting the operator located on said attachment during drilling, said protective canopy being formed having a generally circular shape and is located between the mine roof and the operator, said circular canopy being rotatable through its approximate center along with said base means and having an aperture formed therein for permitting passage of said drilling means from said base means to such mine roof for drilling such mine roof while protecting said operator from falls above.

* * * * *

UNITED STATES PATENT AND TRADEMARK OFFICE

CERTIFICATE OF CORRECTION

PATENT NO. : 4,098,353
DATED : July 4, 1978
INVENTOR(S) : Walter Hood, Joseph Subrick, and Woods G. Talman.

It is certified that error appears in the above-identified patent and that said Letters Patent are hereby corrected as shown below:

Column 5, Line 1, after "pass" insert -- from --.

Column 7, Line 45, after "multiple" insert -- rotatable --.

Column 8, Line 68, change "in" to -- is --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*